US006805899B2

(12) United States Patent
MacHattie et al.

(10) Patent No.: US 6,805,899 B2
(45) Date of Patent: Oct. 19, 2004

(54) MULTI-MEASUREMENT/SENSOR COATING CONSOLIDATION DETECTION METHOD AND SYSTEM

(75) Inventors: Ross K. MacHattie, Snellville, GA (US); Edward Belotserkovsky, San Francisco, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/061,586

(22) Filed: Jan. 30, 2002

(65) Prior Publication Data

US 2003/0143317 A1 Jul. 31, 2003

(51) Int. Cl.[7] ..... B05D 3/00

(52) U.S. Cl. ..... 427/8; 374/100; 702/127; 702/130; 73/73

(58) Field of Search ..... 427/8, 9, 10; 34/89; 702/127, 130; 162/DIG. 11; 73/73; 118/712; 374/100

(56) References Cited

U.S. PATENT DOCUMENTS

| | | | | |
|---|---|---|---|---|
| 4,087,568 | A | * | 5/1978 | Fay et al. ..... 427/8 |
| 4,957,770 | A | | 9/1990 | Howarth |
| 5,124,552 | A | | 6/1992 | Anderson |
| 5,250,811 | A | | 10/1993 | Lippert et al. |
| 5,533,139 | A | | 7/1996 | Parker et al. |
| 5,596,409 | A | | 1/1997 | Marcus et al. |
| 5,625,196 | A | | 4/1997 | Williams |
| 5,659,392 | A | | 8/1997 | Marcus et al. |
| 5,822,070 | A | | 10/1998 | Syré |
| 5,899,959 | A | | 5/1999 | Shields et al. |
| 5,960,374 | A | | 9/1999 | Lausier |
| 6,034,772 | A | | 3/2000 | Marcus et al. |
| 6,038,027 | A | | 3/2000 | Marcus et al. |
| 6,060,677 | A | | 5/2000 | Ulrichsen et al. |
| 6,067,161 | A | | 5/2000 | Marcus et al. |
| 6,191,430 | B1 | | 2/2001 | Belotserkovsky et al. |
| 6,259,109 | B1 | | 7/2001 | Dalmia et al. |
| 6,393,719 | B1 | * | 5/2002 | Stipp ..... 34/115 |

FOREIGN PATENT DOCUMENTS

| | | | |
|---|---|---|---|
| FI | 71020 | | 7/1985 |
| FR | 2667940 | A | 4/1992 |
| FR | 2 667 940 | | 4/1992 |
| GB | 2178843 | A | 2/1987 |
| WO | 0031521 | A | 2/2000 |
| WO | 00/52265 | * | 9/2000 |

OTHER PUBLICATIONS

International Search Report, dated Oct. 21, 2003, relative to PCT application No. PCT/US 03/02553, the foreign equivalent to the instant U.S. application 10/061,586.

Graab, H (1983), Wochenbl. Papierfabr. 111, "Drying of Coated Papers", No. 17: pps. 645–646, 648–649.

Voss and Garber (1975), TAPPI 58, "Correlations Between Drying Conditions and Quality of Coated Paper": pps. 99–103.

Xiang et al. (1999), "The Cause of Backtrap Mottle: Chemical or Physical?".

* cited by examiner

*Primary Examiner*—Katherine A. Bareford
(74) *Attorney, Agent, or Firm*—Ohlandt, Greeley, Ruggiero & Perce, LLP

(57) ABSTRACT

A system and method for processing measurements of a coating operation of a moving web, such as paper or plastic. A plurality of sensors are deployed at essentially the same cross direction (CD) locations and at different machine directions (MD) of the web. A measurement processor produces a plurality of measurement signal samples for each of the MD locations. The system also includes a computer that processes the signal samples produced by the measurement processor with correction data obtained from a quality control system and a distributed processing system. The signal samples of all the locations are combined to produce an MD profile of a characteristic of the web, such as moisture content, temperature, coating weight, drying rate and the like. The MD profile is adjusted with the correction data, which includes parameters, such as, dryer air temperature, dryer air pressure, web speed, base paper, coating formulation, coating weight, incoming moisture level, outgoing moisture level and infrared energy.

9 Claims, 5 Drawing Sheets

MULTI-MEASUREMENT/SENSOR COATING CONSOLIDATION DETECTION METHOD AND SYSTEM

FIELD OF THE INVENTION

This invention relates to a method and system for processing coating consolidation data of a moving web.

BACKGROUND OF THE INVENTION

A system for depositing a coating on a web generally has a take up reel and a supply reel arranged to move the web along a path from the supply reel to the take up reel, but could also be an integral part of a complete paper making machine. A coating station that deposits a coating on the moving web is disposed along the path followed by one or more dryers that dry the coating before the web is taken up on the take up reel or passed on to the next part of the paper making machine.

In the production of pigment-coated paper or paperboard, the method and rate of drying of the coating significantly influences the print quality of the finished product, as noted by Voss, H., and Gärber, W. E., "*Correlations Between Drying Conditions And Quality Of Coated Paper*", 1975 TAPPI 58 (9) pages 99–103, Graab, H., "*Drying Of Coated Papers*", translated by IPST from Wochenbl. Papierfabr. 111, No. 17: 645–646, 648–649 (Sep. 15, 1983). Improper drying during initial stages can cause binder migration that leads to its non-uniform concentration on the surface of the coating, or pore structure variations across the surface (Xiang, Y., Bousfield, D., Coleman, P., and Osgood, A., "*The Cause of Backtrap Mottle: Chemical or Physical?*", 1999). Such effects are thought to cause print mottle, which is the primary reason for poor print quality.

Gloss is the ratio of specularly reflected light to incident light. For optically smooth surfaces, gloss varies with refractive index and angle of incidence according to Fresnel's law. Gloss is also a function of roughness and can be used to characterize surface roughness. When the roughness is of the same order of magnitude as the wavelength of light, ("microscopic" roughness), gloss varies exponentially with the ratio of roughness to the wavelength of light.

In recent years, much work has been done to model the coater drying and predict dryer settings that optimize final quality. Part of the modeling is a calculation of the gel point of the coating, i.e., the location of the web path at which binder immobilization has occurred. This calculation requires extensive man-hours to determine the specific values of each parameter to apply to the model for each grade on each coater. Parameters that are required for the modeling include coat weight, temperature, and moisture, among others.

Finnish Patent No. 71,020 describes a method for following the solidification process of pigment coatings on paper, especially for on-line operations. According to the method, the paper is illuminated and the intensity of the transmitted light, the brightness of the paper and/or the gloss of the paper are determined as a function of time elapsed from the moment of the application of the coating.

French Patent No. 2,667,940 describes a method to give a continuous measurement of the dynamic water retention in a coated web, particularly paper after a fluid coating application. A wave train in a known frequency spectrum is generated at a plane in relation to the moving web and at a different incidence angle from the standards to the plane defined by the web, at a gap of 0–2 m from the coating station. The receivers are on the same plane as the signals of the wave train reflected from the web. The values of the received signals are used to register the volume of the damp applied coating layer. Each measurement is repeated at an interval that is greater than the gap between the first measurement and the coating station, but less than 2–20 m from the coating station, to give values of the same level to show the changes over time to base the control for a constant web speed of travel. The mean rise in the change indicates the penetration speed of the fluid in the web and the sought-for dynamic retention of the fluid in the web.

U.S. Pat. No. 6,191,430 B1 describes a system having a measuring device that provides a comparison of the specular and diffused radiation reflected from a coating that can be used in ratio to locate the gel point of the coating and to monitor coating drying characteristics. The gel point data is compared to base line data. The system may also be used to monitor the drying process of the coatings in an off-line lab setting to obtain off-line data that may be used to help calibrate on-line gel point sensor systems.

U.S. Pat. No. 5,124,552 describes a measuring device that incorporates an infrared web moisture sensor and a web temperature measurement. It comprises a source of infrared radiation and infrared-detecting units, which measure the infrared beam at three separate wavelength regions. The first wavelength region is primarily sensitive to the moisture content of the web, the second wavelength region is less sensitive to the moisture content, and the third wavelength region provides an indication of the web temperature.

U.S. Pat. No. 4,957,770 describes a sensor and a method for determining the basis weight of coating material on a substrate is described. The determined basis weight is insensitive to changes in the amount of substrate material underlying the coating. Signals from the sensor may be used in the control of a coating mechanism to provide a coating having a uniform basis weight.

What is needed is a system and method that produces machine direction data along a moving web that is based on measurements of a large number of variables at enough locations to account for non-linearities.

There is also a need for a system and method that dynamically updates machine direction data derived from measurements taken at a plurality of locations along a moving web.

SUMMARY OF THE INVENTION

The system of the present invention processes signals that are sampled at essentially the same cross or lateral direction (CD) locations and at different machine direction (MD) locations along a moving web. The system includes a plurality of sensors disposed at the CD locations. Each sensor includes at least one unit for directing a beam of radiation on the web and at least one unit for receiving radiation returning from the web. A measurement processor processes the returned radiation to produce signal samples of measurements of two or more characteristics of the web for each of the MD locations. A computer performs the operations of:(a) combining the signal samples to produce at least one machine direction profile of a characteristic of the web; and combining the at least one machine direction profile with correction data to produce a corrected machine direction profile of said characteristic. The correction data is obtained from a quality control system and/or distributed control system and includes variables, such as dryer air temperature, web temperature, web moisture content, web basis weight, dryer air pressure, web speed, base paper, coating formulation, coating weight and infrared energy.

The method of the present invention processes signals sampled at different locations along a machine direction of a moving web. The signal samples are combined to produce at least one machine direction profile of a characteristic of the web. The machine direction profile is combined with correction data to produce a corrected machine direction profile of the characteristic.

According to an aspect of the invention, the signals sampled at each location represent one or more of the group consisting of: moisture content, gloss, color, clay content, latex content, $CaCO_3$ content, smoothness and temperature.

According to another aspect of the invention, the corrected machine direction profile is presented to a user.

According to another aspect of the invention, the corrected machine direction profile is used to control a system that moves the web and/or performs operations on the web. The operations may include coating the web with a wet material and drying the coated web.

According to another aspect of the invention, the correction data include one or more from the group consisting of: dryer air temperature, web temperature, web moisture content, web basis weight, dryer air pressure, web speed, base paper, coating formulation, coating weight and infrared energy.

According to another aspect of the invention, the signals are sampled at a first rate and the corrected machine data is dynamically updated at a second rate, which is the same as or slower than the first rate.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
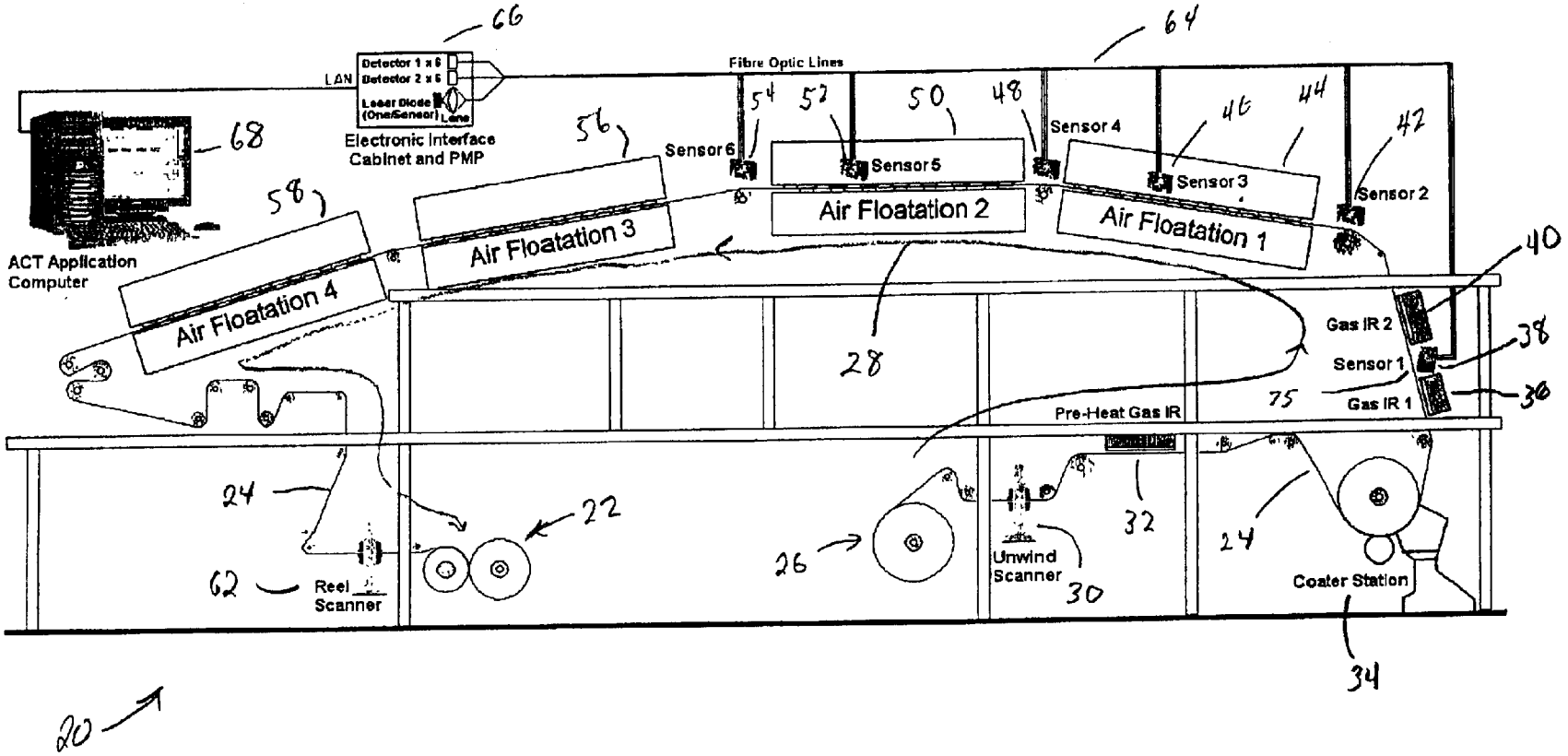
FIG. 1 is a diagram of a coating system of the present invention.

It is contemplated that the web coating system of the present invention can be a stand alone system or a part on a web making machine that may have one or more motive means for moving a web. By way of example, the web coating system of the present invention will be described herein for the case of a stand alone system. Referring to FIG. 1, a web coating system 20 includes a take up reel 22 that is driven by a motor (not shown) for drawing a web 24 from a supply reel 26 along a path 28, which is represented by an arrow. Disposed along path 28 are an unwind scanner 30, a pre-heater 32, a coater station 34, a gas and infrared (IR) dryer 36, a sensor 38, a gas and IR dryer 40, a sensor 42, an air floatation dryer 44, a sensor 46, a sensor 48, an air floatation dryer 50, a sensor 52, a sensor 54, an air floatation dryer 56, an air floatation dryer 58 and a reel scanner 62.

Web 24 may be any suitable sheet material, such as paper, plastic and the like, upon which it is desired to apply a coating. For example, web 24 may be paper upon which a gloss coating is to be applied.

Take up reel 22 is operable to draw web 24 from supply reel 26 along path 28 at a suitable coating speed, for example, about 1,000 meters/min. Pre-heater 32 is operable to pre-heat web 24 to a suitable temperature, for example, in the range of about 30° C. to about 90° C. Coating station 34 is operable to apply a coating to pre-heated web 24. The coating includes a coating material that is suspended in a solvent, such as water. For the paper industry, the coating material may contain components, such as clay, latex or $CaCO_3$ or other materials to affect absorption, stability, gloss, printability or other characteristics. For the plastic industry, the coating may be similar or have photographic or other properties.

As web 24 travels along path 28, dryers 36, 40, 44, 50, 56 and 58 evaporate the solvent out of the coating using heat and/or moving air, leaving a dry coating layer on web 24. The settings of the dryers can be changed as needed to dry the coating before take up reel 22 takes it up. By drying at the correct rate through the dryers, binder migration can be avoided, which is thought to be a leading cause of print mottle.

Unwind scanner 30 and scanner 62 monitor parameters of the web, such as basis weight (mass per unit area), moisture (percent moisture), ash content (inorganic material), caliper (thickness), and the like. Differences between the measurements of these parameters taken by unwind scanner 30 and reel scanner 62 are indicative of the changes in the web, such as how much coating was added to the web. A basic system measures both basis weight and moisture at both scanning locations.

As used herein, machine direction (MD) means the direction of travel of web 24 along path 28 and cross direction (CD) means a lateral direction across web 24 that is perpendicular to MD.

To control the quality of coated web products, it is essential to control the coating consolidation process (drying of the coating). It is necessary to consider several critical web parameters including temperature, moisture, coat weight, coating constituents and gloss. Because the MD profile of coating characteristics is non-linear during the drying process, several measurements of one or more of the critical parameters are necessary between coating station 34 and air floatation dryer 58 to control the coating consolidation process.

To this end, a plurality of sensors is deployed at the same or similar CD locations along path 28 of web 24. These sensors include sensor 38 disposed between gas and IR dryers 36 and 40, sensor 42 disposed between gas and IR dryer 40 and air floatation dryer 44, sensor 46 disposed within air floatation dryer 44, sensor 48 disposed between air floatation dryers 44 and 50, sensor 52 disposed within air floatation dryer 50 and sensor 54 disposed between air floatation dryers 50 and 56. Each of these sensors includes a plurality of sensing units disposed in the same or similar CD location of web 24. That is, each of these sensors is capable of taking a plurality of measurements at each of these MD locations. It will be apparent to those skilled in the art that the number of sensors and CD locations used in system 20 can be varied based on the characteristics of the web and coating material.

The signals sensed by sensors 38, 42, 46, 48, 52 and 54 are conveyed along a connection 64 to a measurement processor 66. Connection 64, e.g., may be a fiber optic cable. Measurement processor 66 is operable to detect from the sensed signals, measurement signals for parameters, such as gel point, moisture, temperature and others. The measurement signals are conveyed to a computer 68 for processing.

Figure 2:
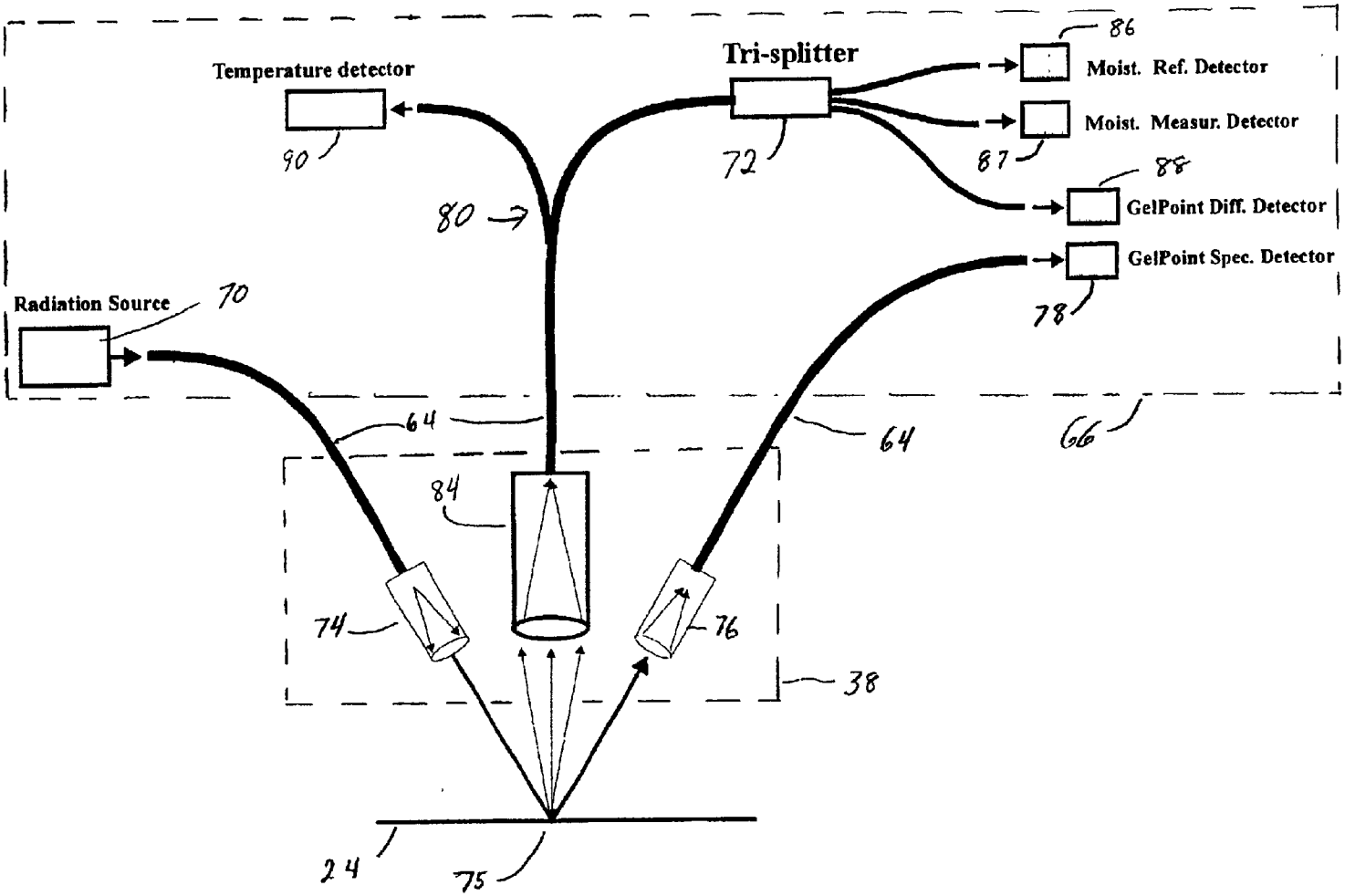
FIG. 2 is a diagram of a measurement processor and a sensor of the FIG. 1 system.

Referring to FIG. 2, measurement processor 66 is shown with one of the sensors, i.e., sensor 38. It will be apparent to those skilled in the art that other sensors will have similar parts. Sensor 38 includes sensor units that are capable of sensing signals from which measurements can be derived from, e.g., gel point, moisture and temperature. These signals are sensed at an MD location 75 between gas and IR dryers 36 and 40. The other sensors at their respective CD locations may sense similar signals. The signals of each sensor are processed by measurement processor 66 to derive measurements of one or more parameters such as, moisture content, gloss, color, clay content, latex content, $CaCO_3$ content, smoothness and temperature.

Preferably, at least two or more of the same type of measurements are derived from each sensor. The sensor units of each sensor are aligned in the cross direction and at a predetermined distance from an edge of web 24. This predetermined distance is the same for each sensor so that the derived measurements of a parameter, e.g., moisture, sensed at different MD locations are for the same lateral point or area of the web.

Sensor 38 includes a lens 74, lens 76 and lens 84. Lens 74 is disposed to focus a beam of radiation at an angle of about 30° to the normal direction to web 24 at MD location 75. For gel point and moisture measurements, the radiation is in the visible and infrared portions, respectively, of the spectrum. Lens 76 is disposed to collect specular radiation reflected from web 24. Lens 76 is disposed at an angle of about −30° to the normal. Lens 84 is disposed at an angle of about 90° to the surface of web 24 to collect diffuse radiation reflected therefrom.

Measurement processor 66 includes a radiation source 70 that provides visible light radiation for gel point measurements and IR radiation for moisture measurements via fiber optic cable 64 to lens 74. Measurement processor 66 also includes a gel point specular detector 78 that receives reflected specular radiation via cable 64 from lens 76. Measurement processor 66 also includes moisture reference detector 86, moisture measurement detector 87, gel point diffuse detector 88 and temperature detector 90 that receive reflected diffuse radiation sensed by lens 84 via cable 64.

Measurement processor 66 includes a splitter arrangement 80 that directs reflected radiation from lens 84 to moisture reference detector 86, moisture measurement detector 87, gel point diffusion detector 88 and temperature detector 90. Measurement processor 66 includes a splitter 66 for directing the radiation from splitter 80 to moisture reference detector 86, moisture measurement detector 87, gel point diffusion detector 88 and temperature detector 90. Measurement processor 66 may include other detectors (not shown) connected via cable 64 to receive reflected radiation from lens 76 or lens 84 for measurement of other characteristics, such as, coat weight and specified components of the coating for a constituent's measurement parameters.

Detectors 78, 86, 87, 88 and 90 may be any suitable detector that monitors radiation of the wavelength being monitored. For example, detectors 86, 87 and 90 that monitor reflected IR may be bolometers, PbS cells, IR cells, photocells and the like. Detector 78 may be similar, but is preferably a photocell.

Angles of about 30° are preferred for lenses 74 and 76, but other angles may be used dependent upon attenuation and sensitivity of lenses 74 and 76, fiber optic cable 64, gel point specular detector 78, gel point diffusion detector 78, moisture reference detector 86, moisture measurement detector 87 and temperature detector 90. Fiber optic cable 64 includes one or more optic fibers.

Lenses 74, 76 and 84 are held in position along MD location 75 and laterally across web 24 by attachment to a frame (not shown) of an associated dryer or to a frame (not shown) of the web conveying system. It will be apparent to those skilled in the art that although sensor 38 (and/or the other sensors) are shown as having lenses 74 and 84 that are shared, separate lenses can be provided for radiation sources 70 and 82 and for detectors 86, 87 and 88. It will also be apparent to those skilled in the art that additional lenses may be provided for additional measurements.

In an alternative embodiment, the sensors at any given MD location could be mounted on a scanning platform (not shown) that enables the sensors to traverse across the machine (various CD locations). The readings of any given CD location would be logged so the data from one MD location are aligned with the appropriate CD readings from a different MD location.

Figure 3:
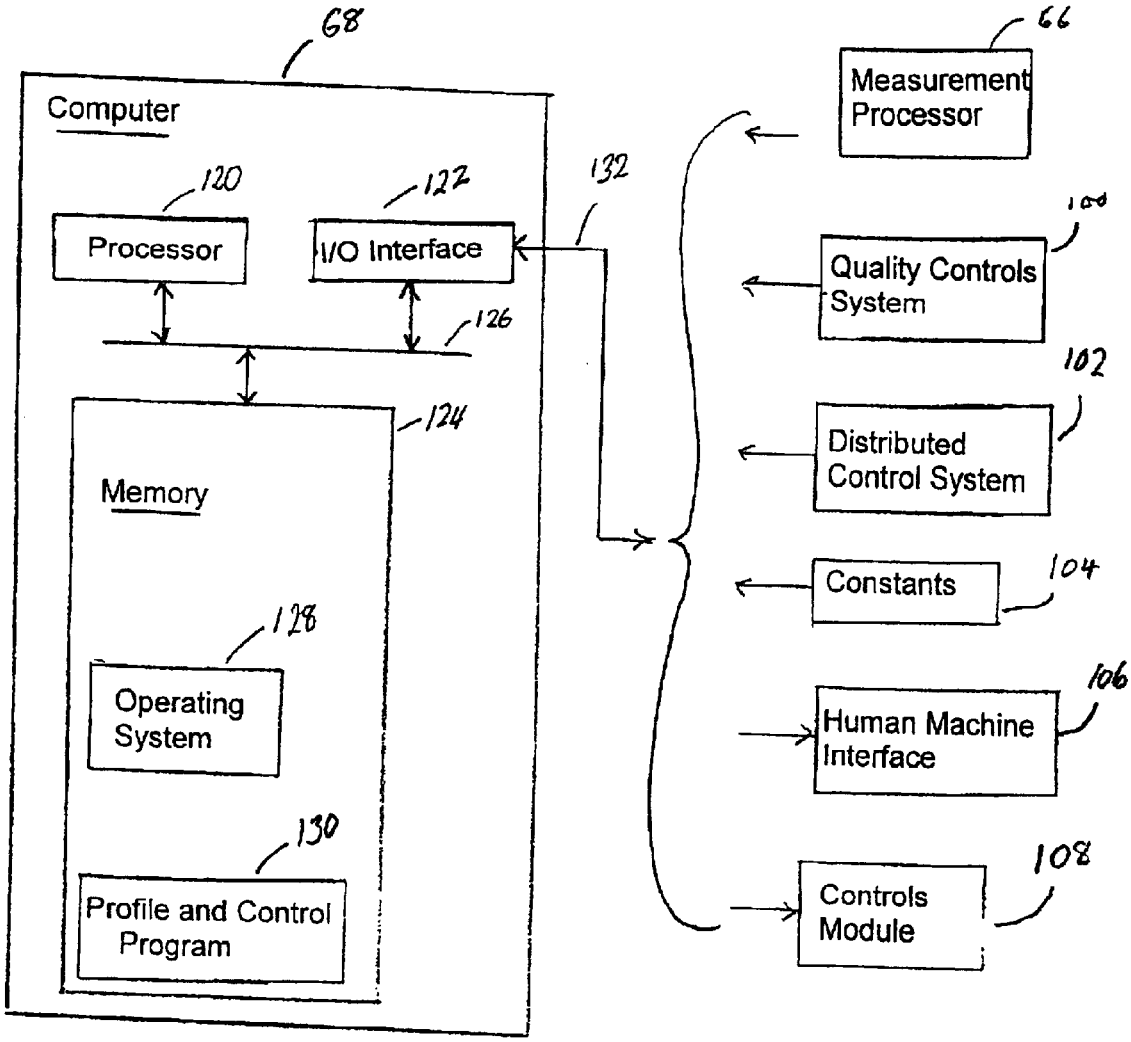
FIG. 3 is a diagram of the computer and its inputs of the FIG. 1 system.

Referring to FIG. 3, computer 68 receives inputs from measurement processor 66, a quality control system 100, a distributed control system 102 and a source of constants 104 and provides outputs to human machine interface 106 and controls module 108.

Quality control system 100 includes one or more scanners that carry one or more sensors back and forth across web 24 to produce CD profiles of web characteristics at that location. This profile data is provided as an input to computer 68.

Distributed control system 102 receives inputs from various measurement devices distributed through system 20 or the plant or mill in which system 20 is located and provides outputs to controllers or actuators for the control of the equipment used in system 20. Distributed control system provides grade data, machine speed, temperature and pressures at various points of the process, coating formulation set point data and may pass the QCS data through to computer 68.

Source of constants 104 include DCS, QCS, laboratory system, values stored in computer 68, parameters of base paper, coating formulation and the like.

Human machine interface 106 is a device that presents a visual image to a user, such as a display, a printer and the like. Computer 28, for example, outputs coating consolidation data in various formats for display to the user. For example, computer 68 develops and presents the MD drying profile graph of FIG. 5 to a user via human machine interface 106.

Controls module 108 is operable to control system 20 in response to outputs from computer 68. For example, computer 68 may instruct controls module 108 to turn off air floatation dryers 56 and 58 based upon the processing of the inputs provided by measurement processor 66, quality control system 100, distributed control system 102 and source of constants 104.

Computer 68 includes a processor 120, an I/O interface 122 and a memory 124 that are all interconnected by a bus 126. An I/O bus 132 connects I/O interface 122 to measurement processor 66, quality control system 100, distributed control system 102, source of constants 104, human machine interface 106 and controls module 108.

Memory 124 includes an operating system 128 and a profile and control program 130 that are stored therein. Memory 124 may include one or more of a random access memory (RAM), hard disk, floppy disk, CD-ROM, cache memory and/or other types of memory devices.

Processor 120 under the control of operating system 128 performs basic utility and other computing functions and provides a platform upon which application programs, such as profile and control program 130 operate. Profile and control program 130, when executed by processor 120, processes the data inputs provided by measurement processor 66, quality control system 100, distributed control system 102 and source of constants 104 to provide outputs to human machine interface 106 and controls module 108.

Figure 4:
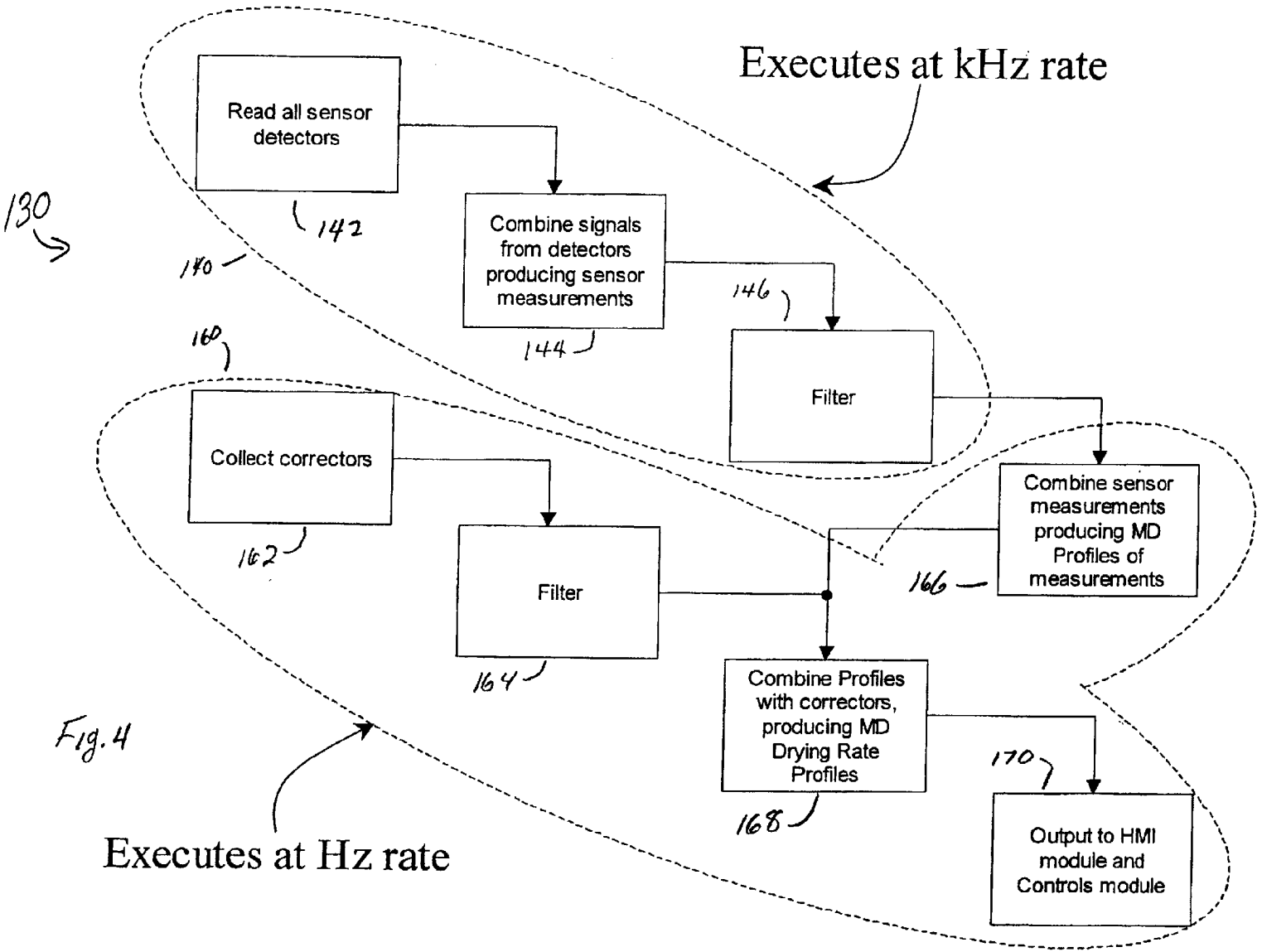
FIG. 4 is a flow diagram of the profile and control program of the computer of FIG. 3.

Referring to FIG. 4, profile and control program 130 includes a processing sequence 140 that operates at a relatively fast rate, e.g., a kilo Hertz (kHz) rate and a processing sequence 160 that operates at a much slower rate, e.g., a rate measured in Hz. For example, sequences 140 and 160 may operate at rates of about 2 kHz and 1 Hz, respectively.

Processing sequence 140 includes a step 142 that reads the measurement signals that measurement processor 66 has derived from all of sensors 38, 42, 46, 48, 52 and 54. Step 144 combines all of the measurement signals read by step 142 to produce sensor measurements for each of the sensors. Step 146 filters the sensor measurements to remove noise.

Processing sequence 160 includes a step 162 that collects correction data from quality control system 100, distributed control system 102 and source of constants 104. Step 164 filters the correction data to remove noise. All of the samples from processing sequence 140 are averaged together during the cycle time of processing sequence 160, thereby reducing noise. Step 166 combines the filtered sensor measurements of processing sequence 140 to produce MD profiles of such measurements. For example, step 166 produces an MD profile of a gloss decay curve or of a moisture content of web 24. Step 166 combines measurements of a given property taken from the different MD locations together in a way that is consistent with the known changes of that property along the length of moving web 24. For signals that change in a linear fashion from one MD location to another, linear interpolation can be used to generate values therebetween for making MD profiles. For properties, such as reflectivity changes that change in a non-linear fashion, modeling of the process is done to determine the mathematical formula that allows for interpolation between data points. For example, a gel point curve could be modeled with the following equation:

$$G(x) = \frac{m}{1 + e^{-\frac{x - x_0}{\sigma}}} + b,$$

where m is a constant multiplier, x is the value at a given position, $x_0$ is the gel point location, b is a constant offset, and ☎ is the slope in the location of the gel point. The data points (measurements) can be used to fit the curve, which is then used to provide the interpolation between the points, yielding an MD Profile. More complicated modeling can also be performed.

Step 168 combines the MD profiles with the filtered correction data to produce MD profiles of a desired characteristic of web 24, for example, drying rate, temperature, moisture, coat weight, gloss, solid percentages, evaporation rate, as well as critical locations, such as the gel point location and/or critical solids locations. For example, step 168 produces an MD profile of the drying rate that can give the evaporation rate at any point from coating station 34 to the CD location of the last selector 34.

The correction data is derived from measurements by other devices on coating system 20 and is used to correct, or improve the MD Profiles. For example, when a gel point profile is adjusted with the information from the unwind and reel scanners that are measuring incoming and outgoing moisture levels, step 168 converts the gel point curve into a drying rate curve. Similarly the MD moisture profile could be combined with the MD gel point profile to not only calibrate the profile in terms of drying rate, but to also make further enhancements to the interpolation between measurements in the MD profile. Other correctors, such as coating formulation can also enhance the correlation of the measurements to drying rate with the knowledge of rheological changes from one formulation to another.

Step 170 transforms the MD profiles into display data for human machine interface 106 or into command data for controls module 108. Step 170 dynamically updates the display and/or command data in real time at the rate of processing sequence 160.

Figure 5:
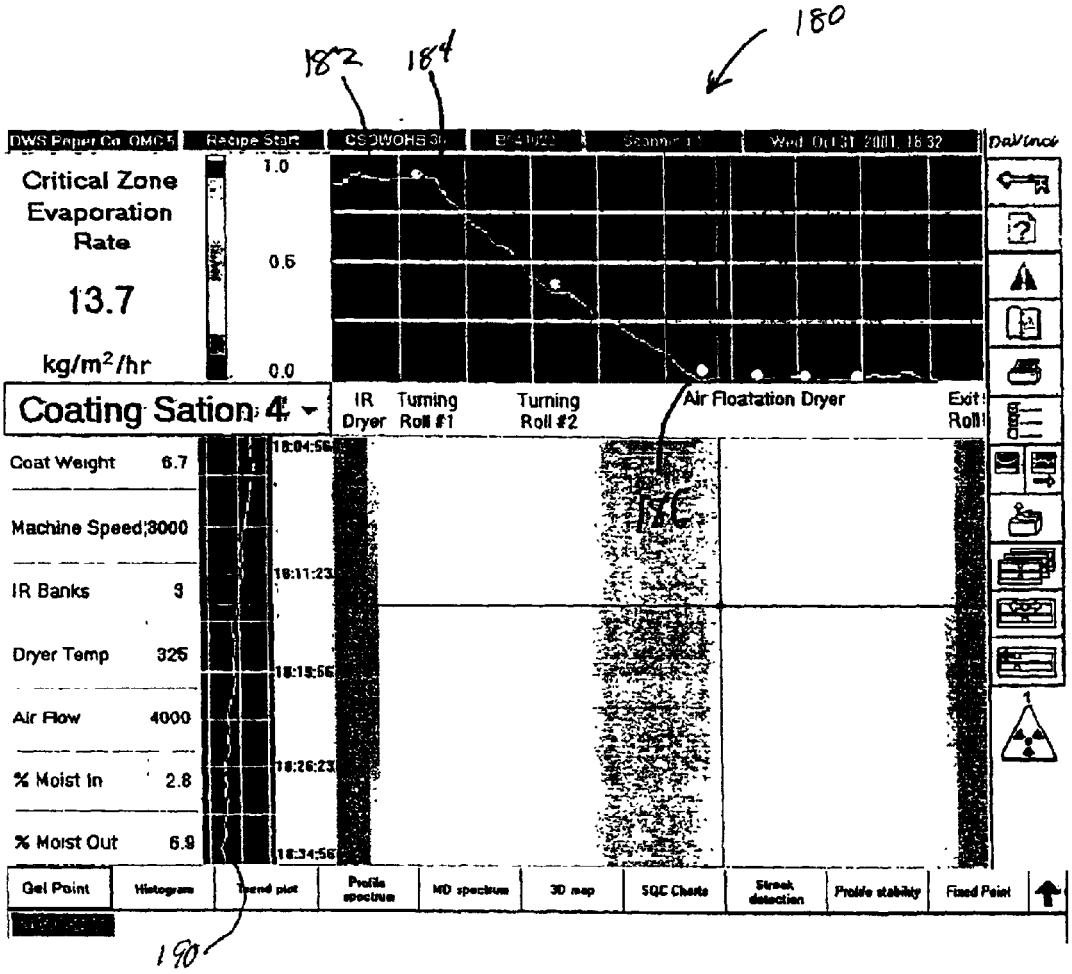
FIG. 5 is a graph that depicts a machine direction drying profile produced by the profile and control program of the computer of FIG. 3.

Referring to FIG. 5, an image 180 includes a curve 182 wherein the ordinate is drying rate in $kg/m^2/h$ and the abscissa is distance from coating station 34 in meters. Curve 182 has first and second critical solids demarcations 184 and 186 that occur at about the locations of sensors 38 and 46 of system 20. Curve 184 indicates that web 24 is fairly dry after passing through air floatation dryer 44, such that one or more of the succeeding dryers 50, 56 and 58 may be turned off.

Image 180 also includes a curve 190 that the time trend of the evaporation rate at a given MD location. It will be apparent to those skilled in the art that MD profiles of other characteristics of the coating process can be presented to human machine interface 106.

The present invention having been thus described with particular reference to the preferred forms thereof, it will be obvious that various changes and modifications may be made therein without departing from the spirit and scope of the present invention as defined in the appended claims.

What is claimed is:

1. A method for processing signals sampled by a plurality of sensors, wherein at least one of said sensors is at a different location along a machine direction of a moving web than another of said sensor, said method comprising:

(a) combining said signal samples to produce at least one machine direction profile of a characteristic of said web; and (b) combining said at least one machine direction profile with correction data to provide a corrected machine direction profile of said characteristic, wherein at least some of said correction data is obtained from sources other than said sensors;

wherein said signals are sampled at a first rate, and wherein step (b) is performed at a second rate, which is slower than said first rate.

2. The method of claim 1, wherein said signals sampled at each location represent at least one property selected from the group consisting of: moisture content, gloss, color, clay content, latex content, $CaCO_3$ content, smoothness, temperature, and mixtures thereof.

3. The method of claim 1, further comprising presenting said corrected machine direction profile to a user.

4. The method of claim 1, further comprising using said corrected machine direction profile to control a system that moves said web and/or performs at least one operation on said web.

5. The method of claim 4, wherein said operation includes coating said web with a wet material and drying said coated web.

6. The method of claim 1, wherein said correction data is selected from the group consisting of: dryer air temperature, dryer air pressure, web speed; base paper, coating formulation, coating weight, incoming moisture level, outgoing moisture level, infrared energy, and mixtures thereof.

7. The method of claim 1, wherein at least one signal sample at the machine direction locations represents a characteristic of said web at a particular cross direction of said web, and wherein said particular locations are the same for at least two machine direction locations.

8. The method of claim 1, wherein a plurality of said different locations are within an area along said web wherein a plurality of like operations are being performed.

9. The method of claim 8, wherein said like operations are selected from the group consisting of: heating and drying.

* * * * *